US011639804B2

(12) United States Patent
Vause et al.

(10) Patent No.: US 11,639,804 B2
(45) Date of Patent: May 2, 2023

(54) AUTOMATED TESTING OF HVAC DEVICES

(71) Applicant: Trane International Inc., Davidson, NC (US)

(72) Inventors: Christopher R. Vause, Austin, TX (US); Anthony W. Bruno, Blaine, MN (US); Jigar Chimanlal Patel, Woodbury, MN (US); Sudeep Uprety, Woodbury, MN (US); Matthew Allen Faust, Bristol, VA (US)

(73) Assignee: Trane International Inc., Davidson, NC (US)

( * ) Notice: Subject to any disclaimer, the term of this patent is extended or adjusted under 35 U.S.C. 154(b) by 226 days.

(21) Appl. No.: 16/713,317

(22) Filed: Dec. 13, 2019

(65) Prior Publication Data

US 2021/0180820 A1 Jun. 17, 2021

(51) Int. Cl.
*F24F 11/49* (2018.01)
*F24F 11/56* (2018.01)
*F24F 11/64* (2018.01)

(52) U.S. Cl.
CPC ..... *F24F 11/49* (2018.01); *F24F 11/56* (2018.01); *F24F 11/64* (2018.01)

(58) Field of Classification Search
CPC ..... G05B 2219/24053; G05B 2219/2614
See application file for complete search history.

(56) References Cited

U.S. PATENT DOCUMENTS 4,467,616 A 8/1984 Kitauchi
4,501,125 A 2/1985 Han
4,522,336 A 6/1985 Culp
5,276,630 A 1/1994 Baldwin et al.
5,341,988 A 8/1994 Rein et al.
5,481,481 A 1/1996 Frey et al.
5,642,467 A 6/1997 Stover et al.
5,801,940 A 9/1998 Russ et al.
5,911,747 A 6/1999 Gauthier
6,115,713 A 9/2000 Pascucci et al.
6,119,125 A 9/2000 Gloudeman et al.
6,240,326 B1 5/2001 Gloudeman et al.
6,241,156 B1 6/2001 Kline et al.
6,263,387 B1 7/2001 Chrabaszcz
6,832,120 B1 12/2004 Frank et al.
6,964,174 B2 11/2005 Shah
7,017,827 B2 3/2006 Shah et al.
7,031,880 B1 4/2006 Seem et al.
(Continued)

*Primary Examiner* — Santosh R Poudel

(74) *Attorney, Agent, or Firm* — Womble Bond Dickinson (US) LLP

(57) ABSTRACT

Architectures or techniques are presented that can facilitate automated function testing (AFT) in connection with an HVAC system or component thereof. The architectures detailed herein can facilitate creation, modification, or duplication of quiz data (e.g., a test). This quiz data can be executed in order to automatically test the function of the HVAC system or component. Additionally, prior to execution, a verification procedure can be performed to ensure that an expected state indicated in the quiz data can in fact be exhibited by the device. Further, execution of the quiz data can include an exit condition that, when satisfied can cause termination of the execution prior to completion. Such can be useful to avoid potentially dangerous situations or to avoid undue disruption to a service provided by the HVAC system.

19 Claims, 9 Drawing Sheets

(56) References Cited

U.S. PATENT DOCUMENTS

| | | | |
|---|---|---|---|
| 7,206,646 | B2 | 4/2007 | Nixon et al. |
| 7,216,016 | B2 | 5/2007 | Van Ostrand et al. |
| 7,240,106 | B2 | 7/2007 | Cochran et al. |
| 7,444,191 | B2 | 10/2008 | Caldwell et al. |
| 7,533,333 | B2 | 5/2009 | Motoyama et al. |
| 7,567,844 | B2 | 7/2009 | Thomas et al. |
| 7,729,882 | B2 | 6/2010 | Seem |
| 7,849,171 | B2 | 12/2010 | Motoyama et al. |
| 7,904,186 | B2 | 3/2011 | Mairs et al. |
| 7,917,232 | B2 | 3/2011 | McCoy et al. |
| 7,949,416 | B2 | 5/2011 | Fuller |
| 8,055,387 | B2 | 11/2011 | McCoy et al. |
| 8,073,555 | B2 | 12/2011 | Fuller |
| 8,090,456 | B2 | 1/2012 | Karpman et al. |
| 8,099,178 | B2 | 1/2012 | Mairs et al. |
| 8,224,489 | B2 | 7/2012 | Federspiel |
| 8,290,627 | B2 | 10/2012 | Richards et al. |
| 8,332,178 | B2 | 12/2012 | Simons |
| 8,606,554 | B2 | 12/2013 | Zimmermann et al. |
| 8,635,338 | B2 | 1/2014 | McCoy et al. |
| 8,682,454 | B2 | 3/2014 | Fuller et al. |
| 8,793,022 | B2 | 7/2014 | Uden |
| 8,924,026 | B2 | 12/2014 | Federspiel et al. |
| 9,037,302 | B2 | 5/2015 | O'Neill et al. |
| 9,135,150 | B2 | 9/2015 | Rumble |
| 9,170,574 | B2 | 10/2015 | Fuller et al. |
| 9,429,923 | B2 | 8/2016 | Ward et al. |
| 9,488,400 | B2 | 11/2016 | Him et al. |
| 9,488,969 | B2 | 11/2016 | Brady et al. |
| 9,506,666 | B2 | 11/2016 | Rite |
| 9,582,009 | B2 | 2/2017 | Shahapurkar et al. |
| 10,107,513 | B2 | 10/2018 | Fadell et al. |
| 10,228,153 | B2 | 3/2019 | Lee et al. |
| 10,387,581 | B2 | 8/2019 | Hamstra |
| 2006/0058923 | A1 | 3/2006 | Kruk et al. |
| 2006/0190771 | A1* | 8/2006 | Hefner ..... G06F 11/3684 714/38.14 |
| 2008/0101918 | A1* | 5/2008 | Block ..... F01D 21/003 415/30 |
| 2011/0087988 | A1 | 4/2011 | Ray et al. |
| 2013/0106600 | A1* | 5/2013 | Hall ..... G08B 29/12 340/514 |
| 2013/0111505 | A1* | 5/2013 | Frick ..... G06F 11/263 719/328 |
| 2013/0144444 | A1 | 6/2013 | Ligeret |
| 2013/0339080 | A1 | 12/2013 | Beaulieu et al. |
| 2014/0343886 | A1* | 11/2014 | Berinato ..... G05B 23/0256 702/123 |
| 2015/0134123 | A1 | 5/2015 | Obinelo |
| 2015/0178421 | A1 | 6/2015 | Borrelli et al. |
| 2016/0098639 | A1 | 4/2016 | Choe et al. |
| 2017/0032476 | A1 | 2/2017 | Keil et al. |
| 2017/0153038 | A1* | 6/2017 | Wootton ..... F24F 11/49 |
| 2017/0314800 | A1 | 11/2017 | Bengea et al. |
| 2017/0343228 | A1 | 11/2017 | Dyess et al. |
| 2018/0227172 | A1* | 8/2018 | Hamber ..... H04L 12/6418 |
| 2019/0310616 | A1* | 10/2019 | Reichl ..... G05B 15/02 |

* cited by examiner

AUTOMATED TESTING OF HVAC DEVICES

TECHNICAL FIELD

The present disclosure is directed to systems, apparatuses, and methods for testing HVAC devices within an HVAC system, and more particularly to automated testing of the functionality and/or states of the HVAC devices.

BACKGROUND

Modern heating, ventilation, and air conditioning (HVAC) systems and associated building automation systems (BAS) or control elements can benefit from periodic testing to ensure the systems are functioning properly. As one example, a functional test can ensure that one or more components are operating properly, which can include testing that these components activate or enter the proper state in response to designated stimuli. Traditionally, sequences of operations are tested for accuracy by either manual procedures or testing programs that are substantially hardcoded. Generally, these other testing techniques include manually overriding individual points to "trick" sensors or other equipment. Some systems use partially automated functions such as variable air volume (VAV) auto-commissioning in order to force the system into a different state for which data is collected and interpreted by the tester.

SUMMARY

The following presents a summary to provide a basic understanding of one or more embodiments of the disclosure. This summary is not intended to identify key or critical elements or delineate any scope of the particular embodiments or any scope of the claims. Its sole purpose is to present concepts in a simplified form as a prelude to the more detailed description that is presented later.

According to an embodiment of the present disclosure, a testing device can comprise a processor and a memory that stores executable instructions that, when executed by the processor, facilitate performance of operations. The computer executable instructions can comprise receiving quiz data that defines a test of a device of a heating, ventilation, and air conditioning (HVAC) system. The quiz data can comprise a command that applies a point to the device. The quiz data can further comprise a predicate that is satisfied if the device exhibits an expected state in response to application of the point.

According to an embodiment of this disclosure, the testing device can perform a verification procedure. The verification procedure can be satisfied in response to determining that the device is capable of exhibiting the expected state. In response to the verification procedure being satisfied, the testing device can perform an execution procedure. The execution procedure can comprise various elements. For example, the execution procedure can comprise initiating execution of the quiz data with respect to the device. The execution procedure can further comprise determining an exit condition. The exit condition can be such that, when satisfied, will cause the execution of the quiz data to terminate prior to completion.

In some embodiments, elements described in connection with the systems above can be embodied in different forms such as a computer-implemented method, a computer-readable medium, or another form.

DETAILED DESCRIPTION

Overview

Figure 1:
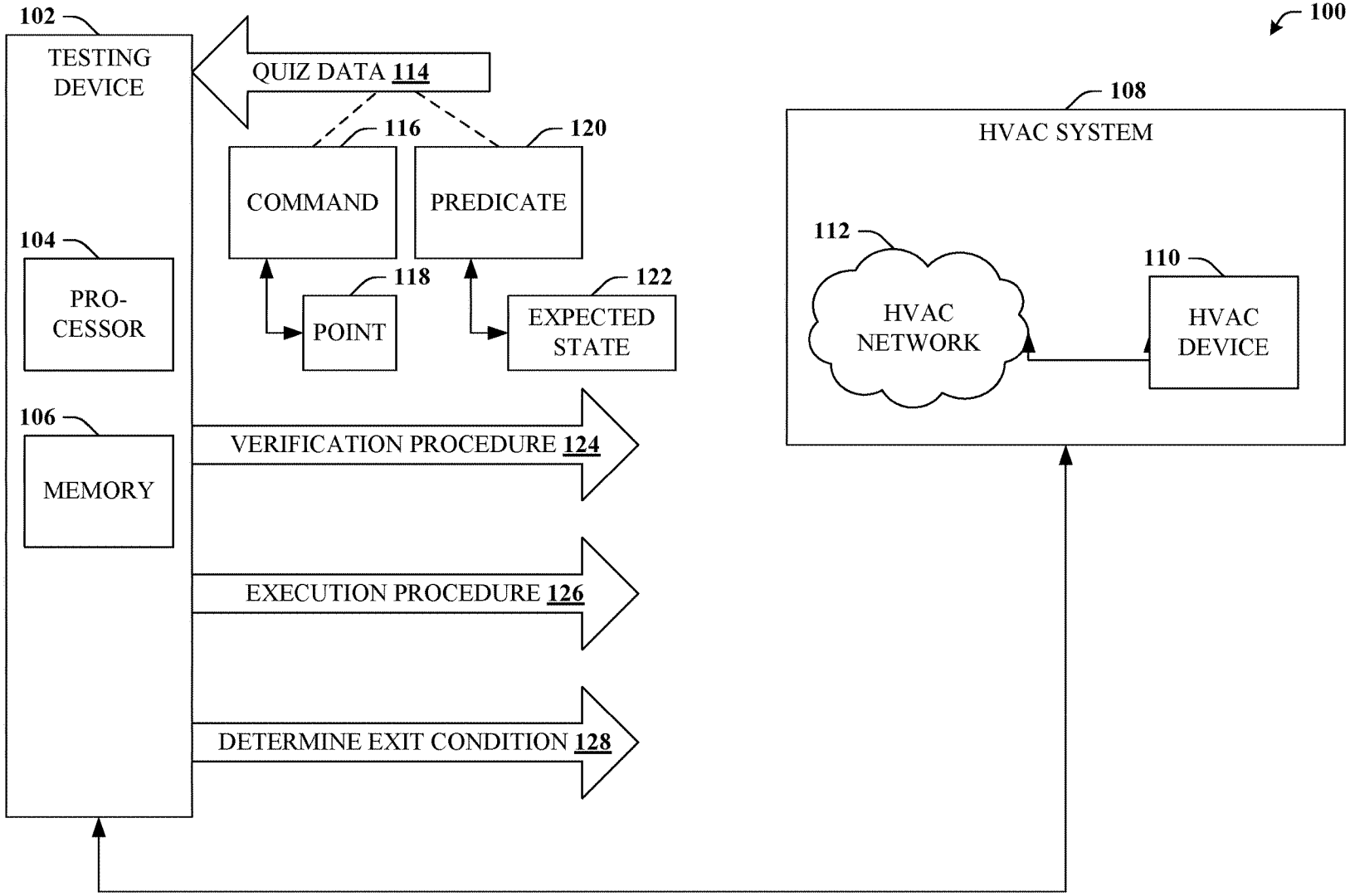
FIG. 1 illustrates a block diagram of an example non-limiting system that can provide automated function testing in accordance with one or more embodiments of the disclosed subject matter.

As used herein a functional test can be a deliberate series of commands/operations on a piece of equipment or system meant to exercise and verify or prove proper operation. When discrete portions (e.g., quizzes) of a test are completed, a report is made to provide feedback (e.g., pass/fail) based on the results of the testing operations. Enhancements in that regard or described herein with respect to testing device that can provide an improved automated function test (AFT).

As outlined above, other systems for functional testing of heating, ventilation, and air conditioning (HVAC) systems tend to rely on manual procedures, which can be time-consuming and error-prone to implement, or hardcoded into testing software, which can be inflexible and difficult to update or improve. In other systems, processes for proper functional testing can be time-consuming as most of a given process is manual and is prone to error or misinterpretation of the written sequence of operation. Misinterpretation of the results and data can be costly when a formal commissioning agent requires changes be made to the programming prior to retesting.

The disclosed subject matter relates to automating the processes used in functional testing of HVAC systems. The disclosed techniques can further collect and collate information from the testing and interpret the results with precision. Furthermore, if the testing procedures are verified by a formal commissioning agent, there will be little or no questions of different interpretations of the specified sequence of operation.

The disclosed testing device can provide a way to test the functionality and sequences of operation of a piece of equipment with or without the full context of other pieces of equipment within the HVAC system. The tests and tools can externally command and change individual points for the purposes of determining a pass/fail result based on some predetermined logical condition. The tests can be editable to account for alterations in the field and/or changes to the original sequence of operation.

In some embodiments, the disclosed systems can interface with a variety of different networks and can be network protocol-agnostic. A given HVAC network protocol (e.g., BACnet, etc) can be interfaced via protocol plugins that can provide useful extensibility to the disclosed system. Significantly, in some embodiments, the disclosed techniques can be more easily tailored to real-world situations. For example, automated testing can be performed in view of safety or operational checks, which are often not extant in a laboratory setting. Hence, exit conditions can be integrated into the automated testing that can, e.g., exit the AFT if a dangerous condition or too much disruption to HVAC services occurs.

In some embodiments, customers or other users can create or choose from a library tests based on their own particular equipment selection. These users are provided the ability to define expected outcomes or device states, test steps, and criteria for the result (e.g., pass/fail) of a test or portion thereof. In addition, the disclosed systems can, in some embodiments, detect that certain predicate conditions (e.g., expected states) can in fact be satisfied by the HVAC device being tested.

Results of a given test can be objective (e.g., Boolean pass/fail) and system granularity can be selected such that a given test can operate on a single HVAC device or component, a specified section of the HVAC system, or even a physical area (e.g., a specified floor of a building), or the like. Significantly, a single test or a collection of individual tests can verify the sequential operation of a building as a whole and/or the entire HVAC system. Many different components can be tested according to individual constraints or in operation in the aggregate. Such can be done in a sequential manner that results in testing of individual predicates to determine whether any one of them fail during testing.

Example Systems

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It may be evident, however, that the disclosed subject matter may be practiced without these specific details. In other instances, well-known structures and devices are shown in block diagram form in order to facilitate describing the disclosed subject matter.

Referring now to the drawings, with initial reference to FIG. 1, a block diagram of an example non-limiting system 100 is depicted that can provide automated function testing in accordance with one or more embodiments of the disclosed subject matter. In some embodiments, system 100 can comprise testing device 102 that can employed to make various determinations or perform various procedures detailed herein. Testing device 102 can comprise a processor 104 and a memory 106 that stores executable instructions that, when executed by the processor, facilitate performance of operations. Additional examples of said processor 104 and memory 106, as well as other suitable computer or computing-based elements, can be found with reference to FIG. 9, and can be used in connection with implementing one or more of the devices or components shown and described in connection with FIG. 1 or other figures disclosed herein. It should be understood that in the discussion of the present embodiment and of embodiments to follow, repetitive description of like elements employed in the various embodiments described herein is omitted for sake of brevity.

System 100 can further comprise a heating, ventilation, and air conditioning (HVAC) device 108. HVAC system 108 can comprise an HVAC device 110. HVAC device 110 can be a physical piece of equipment of HVAC system 108 or in some embodiments can be a software or logic circuit or component that controls a portion of HVAC system 108. HVAC system 108 can further comprise HVAC network 112, which can operate according to any suitable networking protocol. By way of illustration purposes and not limitation, HVAC network 112 can operate according to one or more of a building automation control network (BACnet) protocol, a LonTalk protocol, a KNX protocol, a Modbus protocol, a ZigBee protocol, a Z-Wave protocol, an open source protocol for building automation, and a standardized protocol that is standardized by the American society of heating, refrigeration, and air conditioning engineers (ASHRAE).

Testing device 102 can receive quiz data 114. Quiz data 114 can define a test of an HVAC system. Quiz data 114 can be similar to what is referred to herein as an automated function test (AFT). Quiz data 114 can comprise one or more command(s) 116 and one or more predicate(s) 120. Command 116 can apply a point 118 to HVAC device 110. In some embodiments, point 118 can represent a set point for HVAC device 110. In some embodiments, point 118 can represent an analog value, a binary value, or a multistate value. Predicate 120 can represent, for example, a Boolean logic based comparator of two expressions. An expression can be a low level object that contains a mathematical expression. The expression can contain one or more points 118, numbers or other expressions, which can potentially be recursive. For example, predicate 120 can be satisfied if HVAC device 110 exhibits expected state 122 in response to application of point 118. As an example, consider a fan (e.g., HVAC device 110) that is expected to activate at a particular setting (e.g., expected state 122) in response to some stimuli (e.g., emulated by command 116 that applies point 118).

In addition, testing device 102 can perform verification procedure 124. Verification procedure 124 can be satisfied (e.g., verification is satisfied) in response to determining that HVAC device 110 is capable of exhibiting expected state 122. Hence, testing device 102 can potentially pinpoint errors in quiz data 114 generated by users or others even prior to executing quiz data 114. For instance, if HVAC device 110 cannot exhibit expected state 122, it is already known that particular sequence will fail.

In response to verification procedure 124 being satisfied, testing device 102 can perform execution procedure 126. Execution procedure 126 can include initiating execution of quiz data 114 (e.g., executing the AFT) with respect to HVAC device 110. It is understood that execution procedure 126 can include recursive elements as well as multiple quizzes 114 that can be sequentially executed. Multiple quizzes 114 are referred to herein as an exam. In other words, exam data can comprise multiple, distinct instances of quiz data 114, each potentially referring to difference HVAC devices 110, with different commands 116 and predicates 120.

Execution procedure 126 can further include determine exit condition 128. Exit condition 128 can represent a condition that, when satisfied, will cause the execution of quiz data 114 (e.g., execution procedure 126) to terminate prior to completion. Additional detail with reference to exit condition 128, execution procedure 126, and additional aspects or elements is further discussed in connection with FIG. 2.

Figure 2:
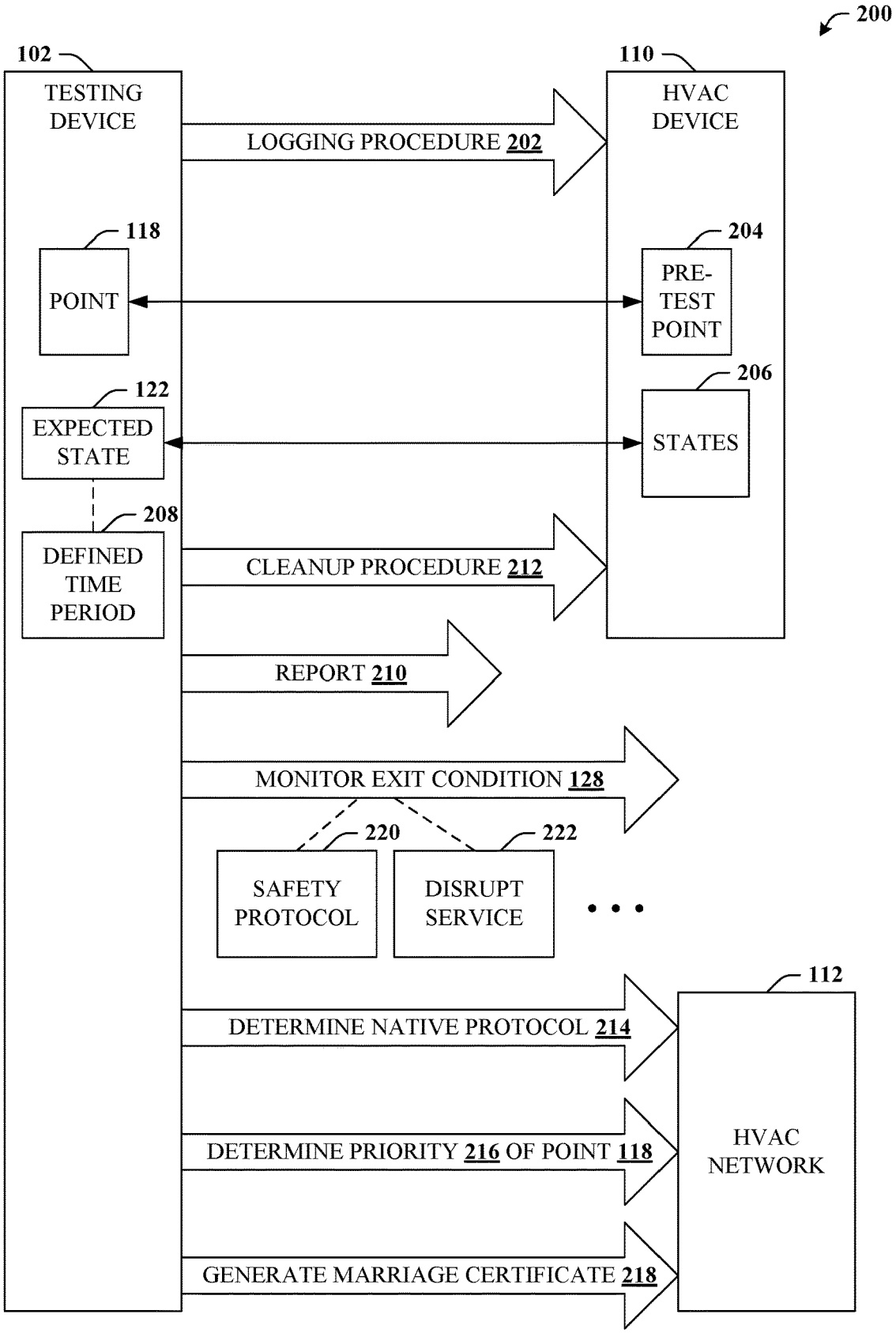
FIG. 2 illustrates a block diagram of a system depicting non-limiting examples of additional aspect or elements in connection with automated function testing in accordance with one or more embodiments of the disclosed subject matter.

Turning now to FIG. 2, a block diagram of system 200 is presented depicting non-limiting examples of system 200. System 200 illustrates additional aspect or elements in connection with automated function testing in accordance with one or more embodiments of the disclosed subject matter. For example, execution procedure 126, can include logging procedure 202. Logging procedure 202 can record pretest point 204 of HVAC device 110. Pretest point 204 can represent a setting or point exhibited by HVAC device 110 prior to execution procedure 126 or a relevant portion thereof.

In some embodiments, in addition to pretest point 204, logging procedure 202 can further record one or more state(s) 206 of HVAC device 110 that are exhibited during execution procedure 126 or other times. During execution procedure 126, state 206 can be compared to expected state 122 to determine whether predicate 120 is or is not satisfied. In some embodiments, a determination of whether expected state 122 is exhibited by HVAC device 110 and/or predicate 120 is satisfied can comprise determining that predicate 120 is satisfied within a defined time period 208 or that predicate 120 is not satisfied if expected state 122 is not exhibited within defined time period 208. In other words, if expected state 122 is not exhibited within defined time period 208, the associated predicate 120 fails.

It is understood that logging procedure 202 can save settings, state data, or other information such that, following termination of execution procedure 126, HVAC device 110 can be reverted to its pretest point(s) 204 and/or previous state(s) 206. Furthermore, the information recorded during logging procedure 202 can be used to generate report 210. Report 210 can represent raw data in any format or a human-readable illustration of point(s) 118 that were applied to HVAC device 110 during execution procedure 126, the resultant state(s) 206 exhibited by HVAC device 110 in response, whether the resultant state 206 exhibited corresponds to expected state 122, and, potentially, timing information such as an amount of time after point 118 was applied that HVAC device 110 exhibited state expected state 122.

In some embodiments, testing device 102 can perform cleanup procedure 212. In operation, cleanup procedure 212 can revert HVAC device 110 to a pretest state such as, for example, by applying pretest point 204 to HVAC device 110. Cleanup procedure 212 can be a portion of execution procedure 126 (e.g., a final portion), or initiate upon execution procedure 126 terminating depending on implementation. For example, in some embodiments, cleanup procedure 212 can initiate in response to exit condition 128 being satisfied (e.g., execution procedure 126 terminated prior to completion). In other embodiments, cleanup procedure 212 can initiate in response to execution procedure 126 completing. It is understood that certain operations can be recursive or involve multiple sub-quizzes or routines. Accordingly, depending on testing goals, HVAC device 110 can be reverted to a previous operational state upon exit or termination of a given sub-portion of the AFT or only after the entire AFT has exited or terminated.

Hence, in some embodiments, during performance of execution procedure 126, testing device can monitor exit condition 128. As discussed, if exit condition 128 is satisfied, execution procedure 126 can terminate prior to completion. In some embodiments, exit condition 128 can be satisfied in response to a determination that execution procedure 126 can violate safety protocol 220. For example, consider again the case in which HVAC device 110 is a fan device having (in response to application of point 118) an expected state 122 of activating. However, further suppose this fan is undergoing maintenance, or is proximal to a different device that is undergoing maintenance, or otherwise maintenance personnel might be in the vicinity. In these or other cases, it can be understood that executing a function test on the fan at this time can violate safety protocol 220.

In some embodiments, exit condition 128 can be satisfied in response to a determination that execution procedure 126 can disrupt service 222. For example, consider the case in which HVAC device 110 is a heating device. During function testing, a temperature set point of a particular space increases beyond a comfort barrier or other defined threshold. In these or other cases, it can be understood that executing a function test on the heating device at this time can disrupt service 222 of HVAC system 108 expected by occupants. It is understood that safety protocol 220 and disrupt service 22 are merely two non-limiting examples of potential exit condition 128 and other examples can be used in addition or alternatively.

As discussed previously, testing device 102 can be configured to operation in conjunction with many different types of HVAC network 112. In some embodiments, testing device 102 can abstract a protocol-agnostic interface to HVAC network 112 that can interact with any suitable type of network, e.g., based on protocol plugins or the like. Prior systems tend to be network-specific without the capability to interface to many different types of HVAC network 112. Such a capability is not trivial because it is very common that elements of device control are typically integrated into various network protocols. Because testing device 102 operates to change points (e.g., pretest point 204) to other values or otherwise take control of HVAC device 110 to some degree, such often must be done within the context of the particular HVAC network 112.

For example, BACnet as one example maintains priorities in connection with points. Thus, if signals are received to change a point of HVAC device 110, the signal with the higher priority will take precedence. Further, in some cases with BACnet or other similar protocols, in order to input a point value to a given HVAC device, sometimes it might be necessary to set an out-of-service flag to true. Other protocols on the other hand might operate differently, with a key take away that the type of protocol employed by HVAC network 112 can affect not only communication but also the operation of how an AFT might work to generate suitable results.

Consider an example in which HVAC network 112 operates according to a BACnet protocol. One goal of a given AFT might be to test HVAC device 110 by applying point 118, which overrides pretest point 204, as detailed above. However, pretest point 204 will likely be associated with a priority value. Hence, in order to override pretest point 204, point 118 should have a priority that is higher. However, the priority of point 118 should have an upper limit because it is not desirable to override pretest point 204 when such could jeopardize safety or cause damage.

In some embodiments, testing device can determine native protocol 214. Native protocol 214 can be representative of a protocol by which HVAC network 112 operates, such as, for example BACnet or Lontalk. As noted, testing device 102 can be network-agnostic and can interface to HVAC network 112 according to native protocol 214. In some embodiments, testing device 102 can determine a priority 216 of point 118 based at least in part on native protocol 214. For example, based on native protocol 216 (e.g., BACnet) priority 216 can be selected to be higher than ordinary priorities, but lower than safety priorities. Thus, in ordinary cases, priority 216 will be higher than a priority of pretest point 204 allowing one to be overwritten with the other, but denying the overwrite in the event that priority 216 is not higher than that for pretest point 204 (e.g., in cases where pretest point has a priority that is ensures a safety protocol or the like).

In some embodiments, testing device 102 can further comprise generating marriage certificate 218. Marriage certificate 218 can be, e.g., a translation object that connects devices an points 118 of quiz data 114 (e.g., a data model) to actual HVAC device(s) 110 and pretest points 204 on a live network. Marriage certificate 218 can handle 'on-the-wire' translations between various systems of measurement, for instance, as execution procedure 126 is performed.

Figure 3:
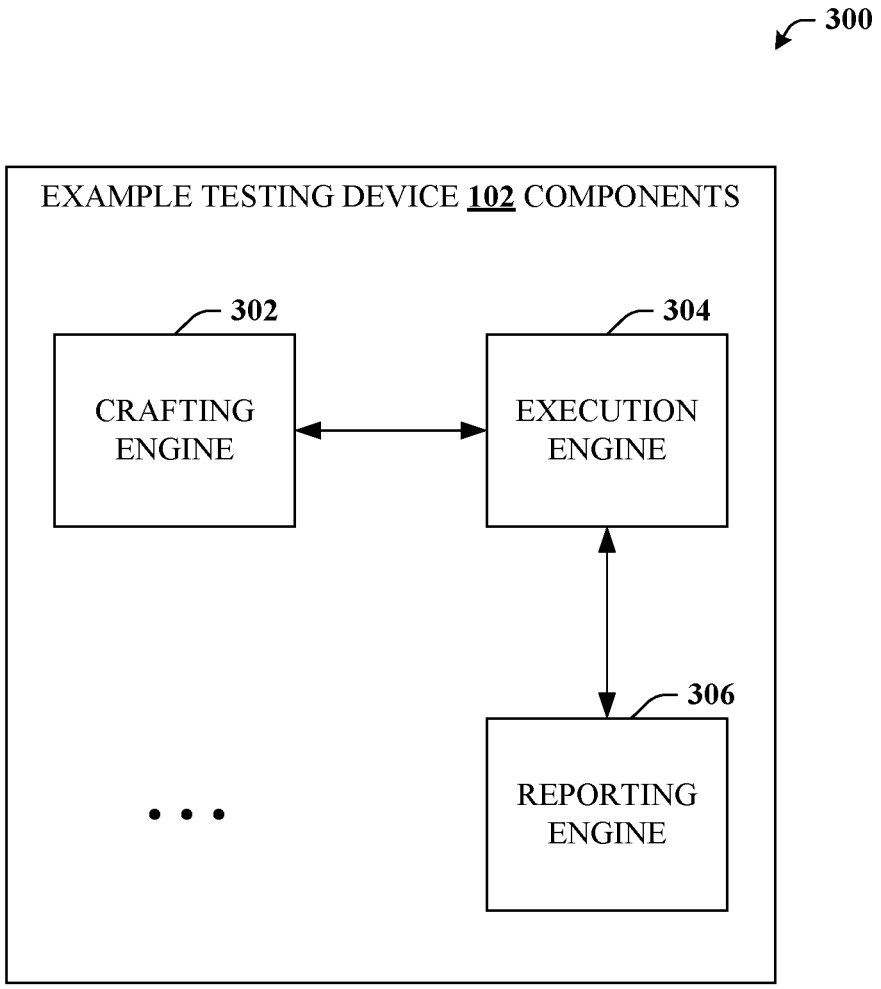
FIG. 3 illustrates a block diagram of a system depicting non-limiting examples of components of the testing device in accordance with one or more embodiments of the disclosed subject matter.

With reference now to FIG. 3, a block diagram 300 is presented depicting non-limiting examples of components of the testing device in accordance with one or more embodiments of the disclosed subject matter. In some embodiments, testing device 102 can comprise crafting engine 302. Crafting engine 302 can perform various sets of offline operations and online operations. As example offline operations, crafting engine 302 can facilitate creation and editing of quiz data 114 or suitable portions of quiz data 114. Such can be augmented with access to test library storage such as AFT 506 that is further discussed in connection with FIG. 5. As example online operations, crafting engine 302 can facilitate device discovery on link such as detecting or discovering HVAC device 110 when connected to HVAC network 112. Crafting engine might also provide resolution or application of various tests to devices and provide graphical support during execution of tests.

In some embodiments, testing device 102 can comprise execution engine 304. Execution engine 304 can perform the execution of commands 116 and is typically invoked during execution procedure 126. Execution engine 304 can further collect data such as elements detailed in connection with logging procedure 202. Further, in some instances at conclusion of execution procedure 126, execution engine 304 can interpret results and associate those results with corresponding HVAC device(s) 110. In some embodiments, execution engine 304 can further perform all or a portion of cleanup procedure 212 or other similar tasks.

In some embodiments, testing device 102 can comprise reporting engine 306. Reporting engine 306 can, for instance, receive data from execution engine 306 and generate a human-readable document that describes the AFT and associated format and indicates results of the AFT.

It is understood that components of testing device 102 can have numerous advantageous characteristics consistent with concepts described herein. For example, execution engine 304 can be portable to many different platforms such as for example a Symbio 800 platform, a Tracer SC+ platform or other suitable platforms employed for building automation or HVAC systems. Execution engine 304 can be designed with some network protocol independence. Hence, execution engine 304 can be interfaced to different network protocols. Further, execution engine 304 can run multiple AFTs (e.g., quizzes) or portions thereof in parallel, which can be asynchronous in execution. Execution engine 304 can also be configured to provide certain live status feedback that can be useful as execution procedure 126 is performed.

Furthermore, reporting engine 306 can also be portable to other platforms such as a TIS platform as well as a Symbio 800 platform, a Tracer SC+ platform or other suitable platforms. In some embodiments, individual components of testing device 102 can be serialized to be used within the context of a suitable database.

Figure 4:
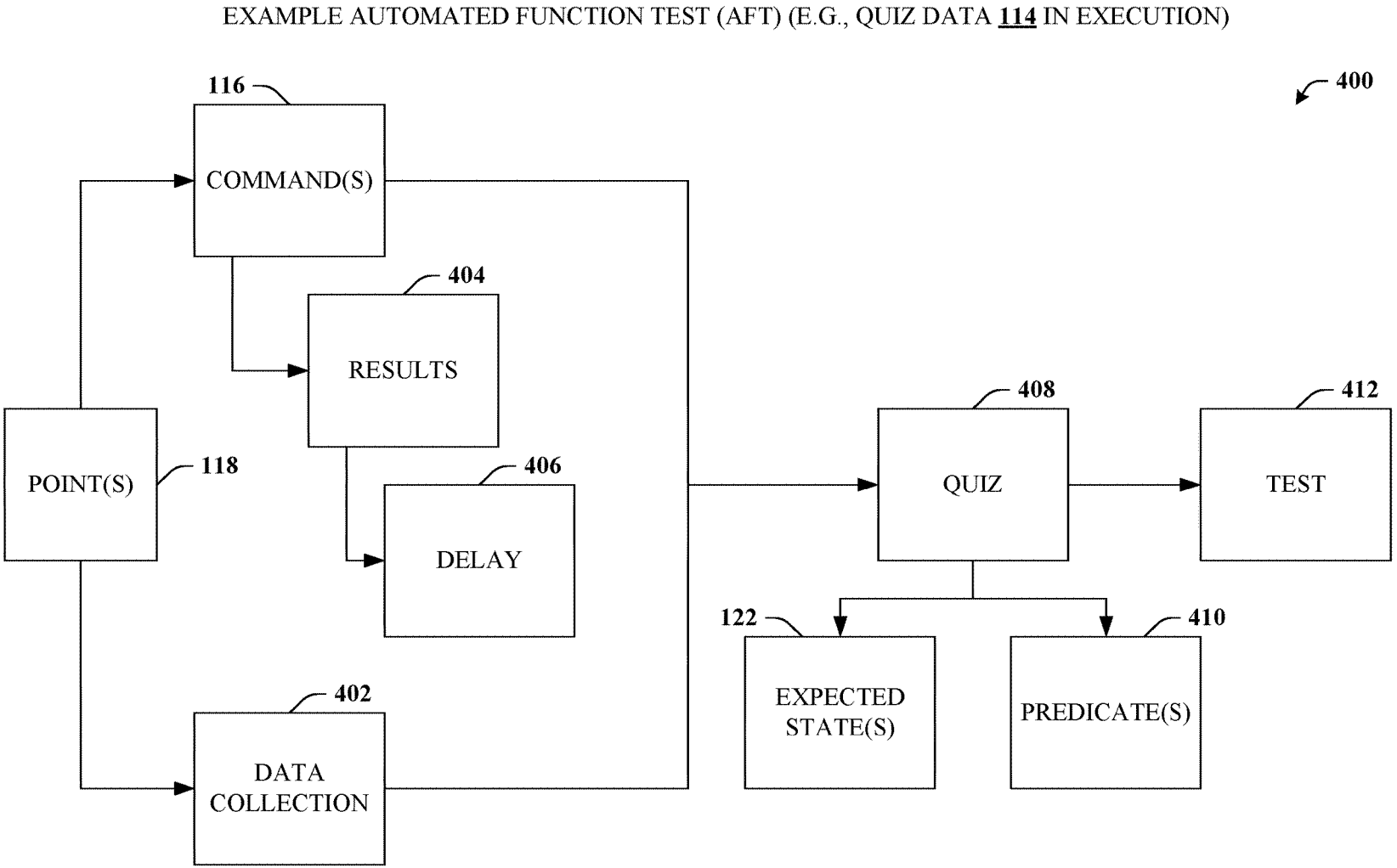
FIG. 4 illustrates a block diagram of a system depicting non-limiting examples of an automated function test in execution in accordance with one or more embodiments of the disclosed subject matter

Referring now to FIG. 4, a block diagram 400 is presented depicting non-limiting examples of an automated function test in execution in accordance with one or more embodiments of the disclosed subject matter. Points 118 can be representative of a fundamental element to a given AFT. As discussed, commands 116 execute on points 118 and resultant data (e.g., states 206) can be collected. Data collection 402 can occur on points 118. Values from points 118 that are assigned to a device during the test can be collected and prepared for inclusion in a report (e.g., report 210). This collected data can further be used by execution engine 304 or a separate evaluation engine to determine results.

Commands 116 can be considered a core component of an AFT representative of actions that are executed on points 118. Results 404 can relate to commands 116 and can represent elements such as, for example, an override of a device, an override release, an in service or an out of service indicator or flag, setting values, and so forth. In some embodiments, delay 406 can be determined or recorded.

Next to be further described is quiz(s) 408. A quiz 408 can represent a collection of commands 116 and data collection 402 members, and can be representative of quiz data 114. Each quiz 408 can constitute a result (e.g., a pass/fail result). In some embodiments, a quiz 408 can have one and only one result. A quiz 408 can have one expected outcome (e.g., expected state 122). It is appreciated that quizzes 408 can be modular in design and can be catalogued in a data store (e.g., AFT library 506 of FIG. 5) for later access or recall. A quiz 408 can be used to test a single instance of functionality as described in an associated sequence of operation.

Expected state(s) 122 can reflect an outcome of a quiz 408, which can be true or false, pass or fail, or the like, typically a binary value that can represent evaluation of some piece of logic. In some embodiments, this binary value can be a result of comparing points 118 to other points or constants. Predicate(s) 410 can represent a prerequisite such as an enable/disable condition that will allow or disallow quiz 408 to execute. Predicates 410 can be a single point 118 or another piece of logic.

Test 412 can represent a collection of quiz 408. A complete test 412 (e.g., defined by quiz data 114) can evaluate all or a portion of a sequence of operation for a system (e.g., HVAC system 108) or a piece of equipment (HVAC device 110). In some embodiments, multiple tests 412 can be aggregated into an exam.

It is understood that because many tests might be running concurrently, it can be advantageous to provide a centralized 'tick' timer. For example, a network 'tick' can be set to 12 seconds, for example, or another suitable duration. This tick timer can be utilized to synchronize network traffic where BACnet (or another network protocol) functions like "read property multiple" (or other protocol equivalent functions)

can be utilized. In addition, any protocol interface can be designed to store a snapshot of the state of each pretest point 204 that will be changed by a command 116. Hence, the pretest point 204 can be returned to its exact original state upon exit of any particular quiz or, if desired, potentially upon exit of a given portion of a quiz.

Figure 5:
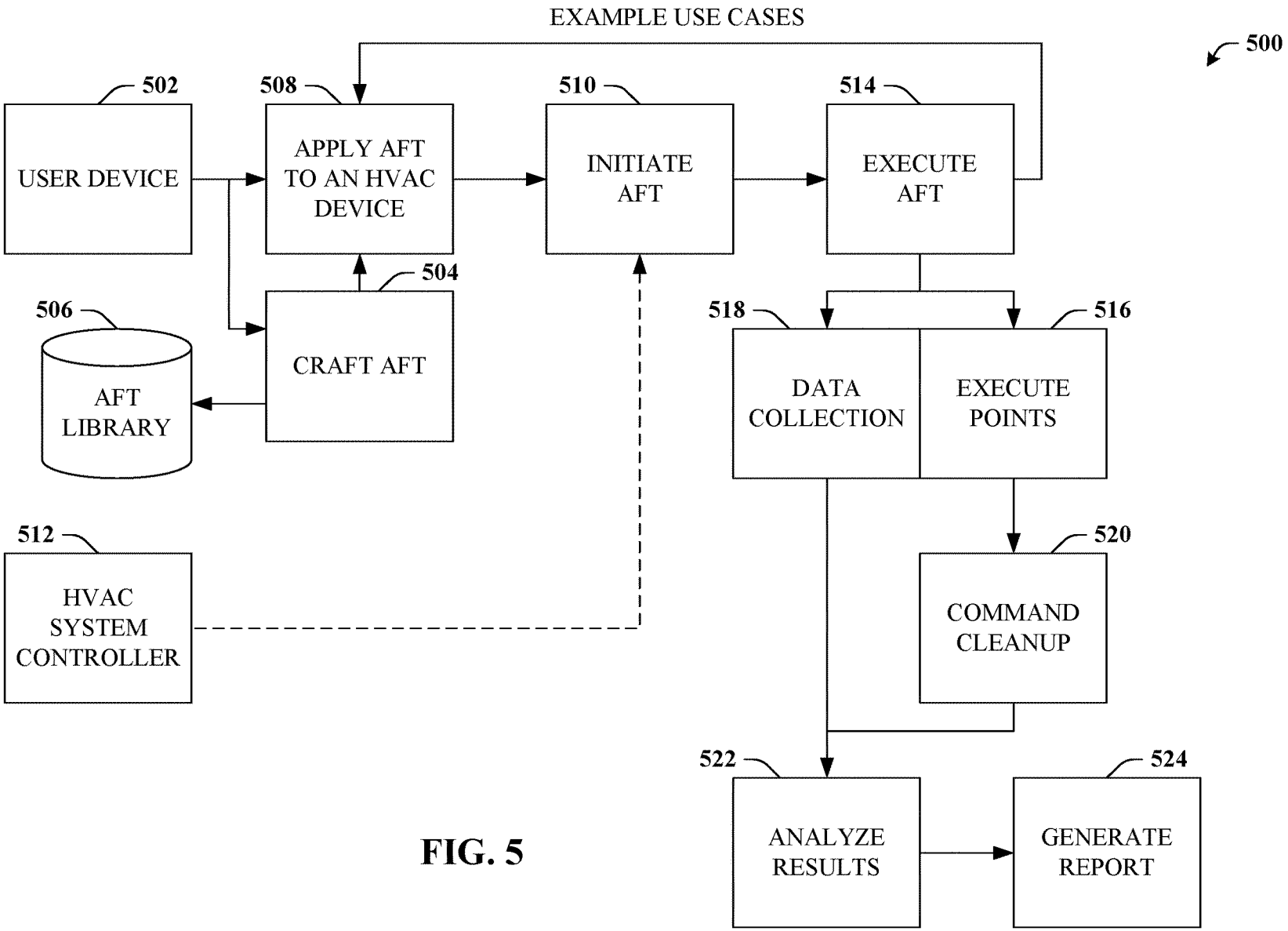
FIG. 5 illustrates a block diagram of a system depicting non-limiting examples of potential use cases in accordance with one or more embodiments of the disclosed subject matter.

Turning now to FIG. 5, a block diagram of system 500 is presented depicting non-limiting examples of potential use cases in accordance with one or more embodiments of the disclosed subject matter. User device 502 can interface to testing device 102, for example in order to craft an AFT indicated at reference numeral 504. The user can generate the AFT from scratch or download suitable tests or quizzes from AFT library 506. If desired, the user can modify tests or quizzes from AFT library to tailor to a particular implementation or event.

At reference numeral 508, the AFT can be applied to an HVAC device and a marriage certificate can be generated. At reference numeral 510, the AFT can be initiated, and at reference numeral 514, the AFT can be executed. In some embodiments, the AFT can alternatively be initiated by HVAC system controller 512. As show at reference numeral 516 points can be executed and, at reference numeral 518, data collection can occur. Subsequently, as illustrated at reference numeral 520, cleanup on commands can commence. At reference numeral 522, results can be analyzed and at reference numeral 524, a report can be generated.

As one example use case consider the case in which a user or technician chooses a series of functional tests to be performed on one or more pieces of equipment. An auto-commissioning function can utilize this information to initiate various functional tests. The auto-commissioning function can display functional testing results and generate standardized reports or user-defined reports. Auto-commissioning function can return equipment to an original state including, e.g., releasing overrides, putting points back in service, and so forth.

As another example use case, consider the case in which CSET (computer system engineering technology) output or standards define equipment, control devices, and functional tests. Auto-commissioning function can consume CSET data and initiate function tests. The auto-commissioning function can display functional testing results and generate standardized reports or user-defined reports. Auto-commissioning function can return equipment to an original state including, e.g., releasing overrides, putting points back in service, and so forth.

In another example use case, consider the case in which a user has a piece of equipment that does not currently have any function test defined. This user can create one or more function test(s). The user can define actions to be take, define expected result(s), define pass/fail criteria for each expected result, and also define what data is to be included in a report. The auto-commissioning function can provide alerts of missing elements or possible hazards to equipment function tests. The user can save function tests for later use or to share with other users.

In yet another example use case, consider the case in which a user has a piece of equipment that is similar to equipment for which an existing AFT was developed. The auto-commissioning function can provide a method of duplicating and editing existing function tests. Auto-commissioning function can further provide alerts of missing elements or possible dangers to persons or equipment.

In still another example use case, consider the case in which a certified commissioning agent provides function tests to be performed on specified equipment. The auto-commissioning function can have a standard format for new criteria to be automatically consumed and incorporated into a library of function tests.

Figure 6A:
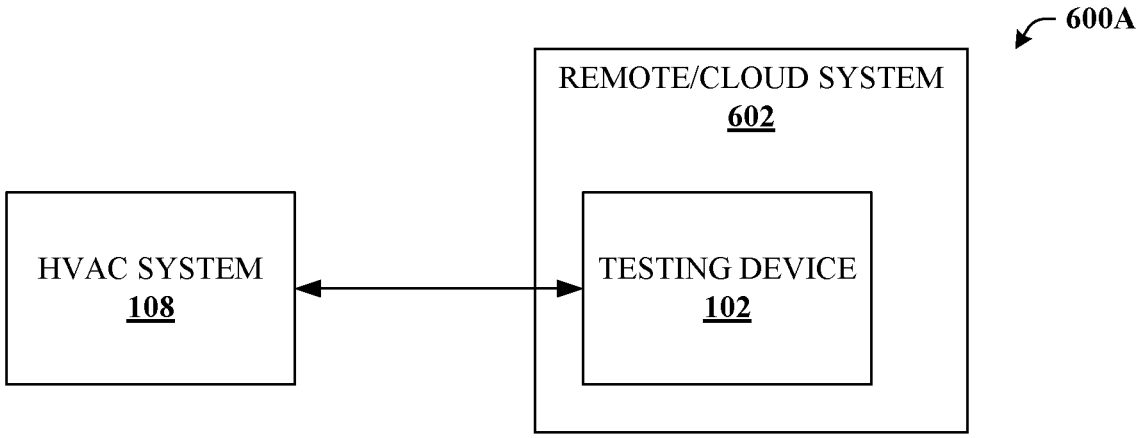
FIGS. 6A-C illustrate block diagrams of example architectural implementations that can be employed in accordance with one or more embodiments of the disclosed subject matter.
Figure 6B:
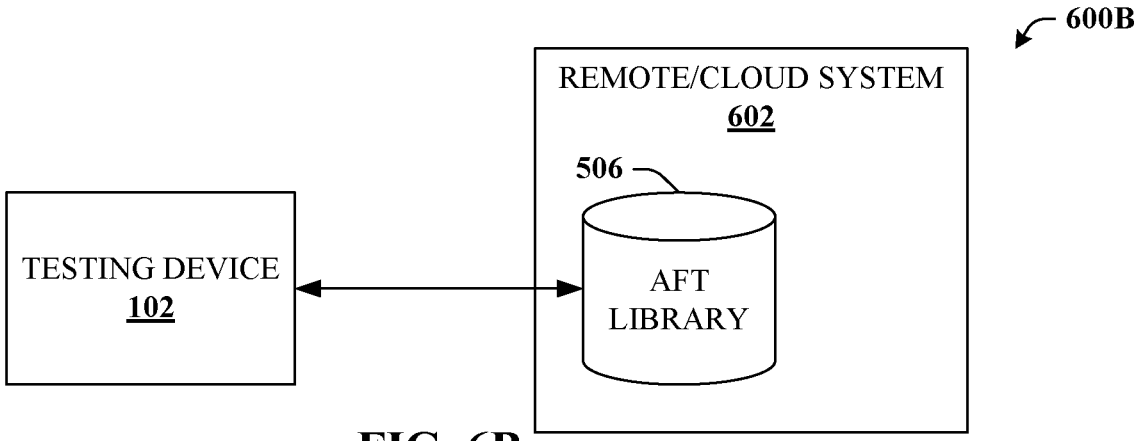
Figure 6C:
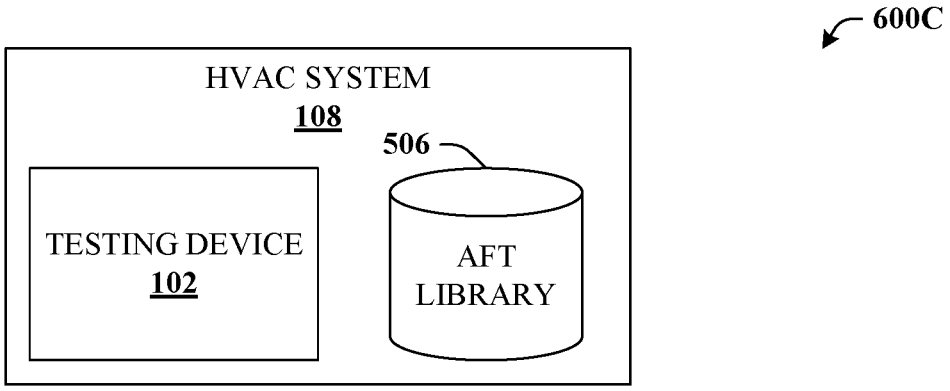

Referring now to FIGS. 6A-6C, various block diagrams 600A-600C of example architectural implementations are illustrated in accordance with one or more embodiments of the disclosed subject matter.

For example, block diagram 600A depicts an example architectural design in which testing device 102 is situated in a remote system such as a cloud system 602. Testing device 102 can be representative of a device that executes an AFT and/or quiz data 114 as illustrated in connection with FIG. 1. In other words, in some embodiments, testing device 102 can be remote from HVAC system 108.

Block diagram 600B depicts an example architectural design in which AFT library 506 is in a remote system such as a cloud system 602. In this embodiment, testing device 102 can be situated at a user site and/or local to the HVAC system 108 and communicate with the cloud to make various determinations. In other embodiments, both testing device 102 and AFT library 506 can be situated in cloud system 602 and communicate with HVAC system 108.

Block diagram 600C depicts an example architectural design in which one or both user testing device 102 and AFT library 506 are components of HVAC system 108, which can be situated at the user site.

Example Methods

Figure 7:
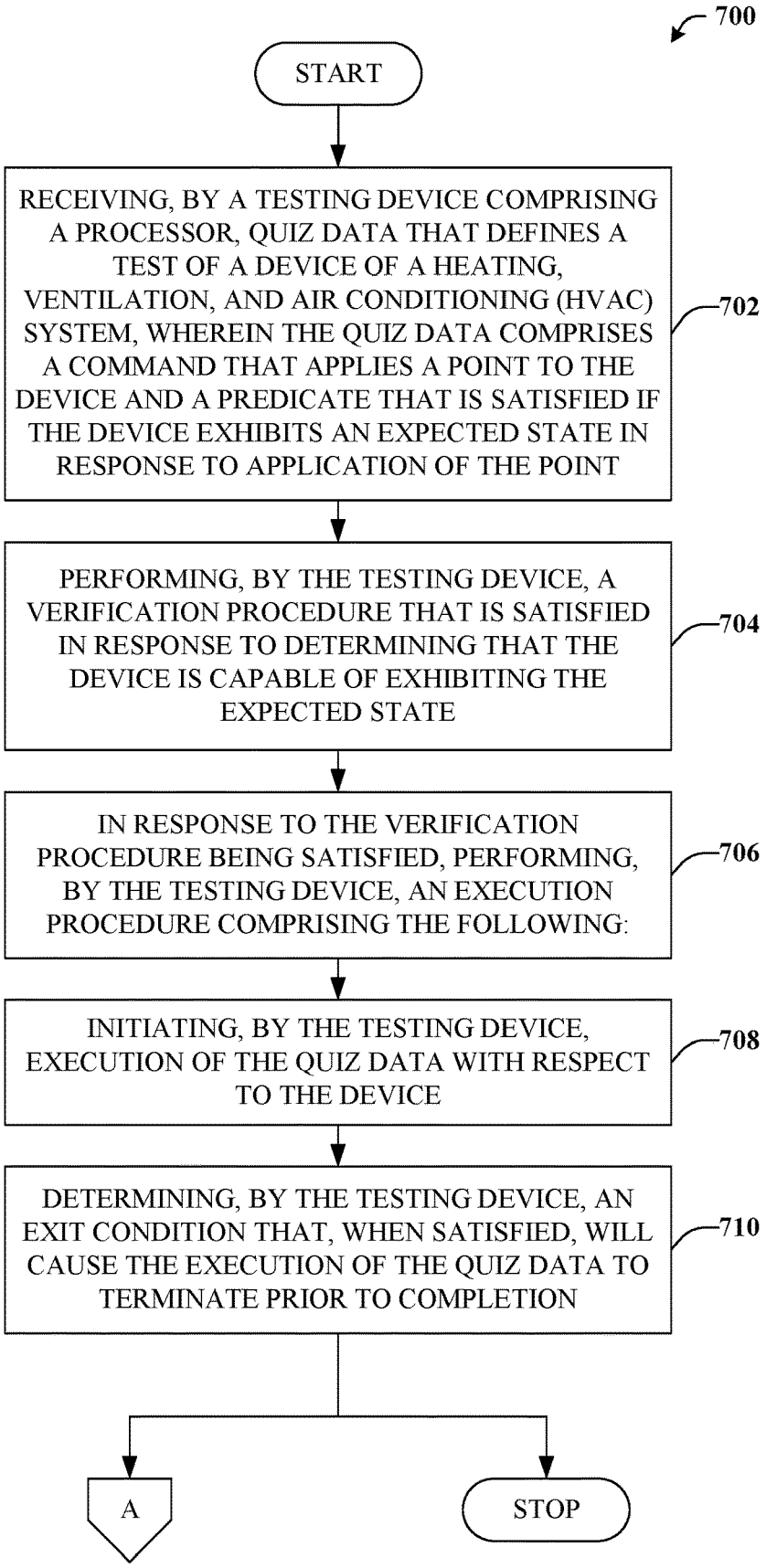
FIG. 7 illustrates a flow diagram of an example, non-limiting computer-implemented method that can perform operations directed to automated function testing of an HVAC device or component in accordance with one or more embodiments of the disclosed subject matter.
Figure 8:
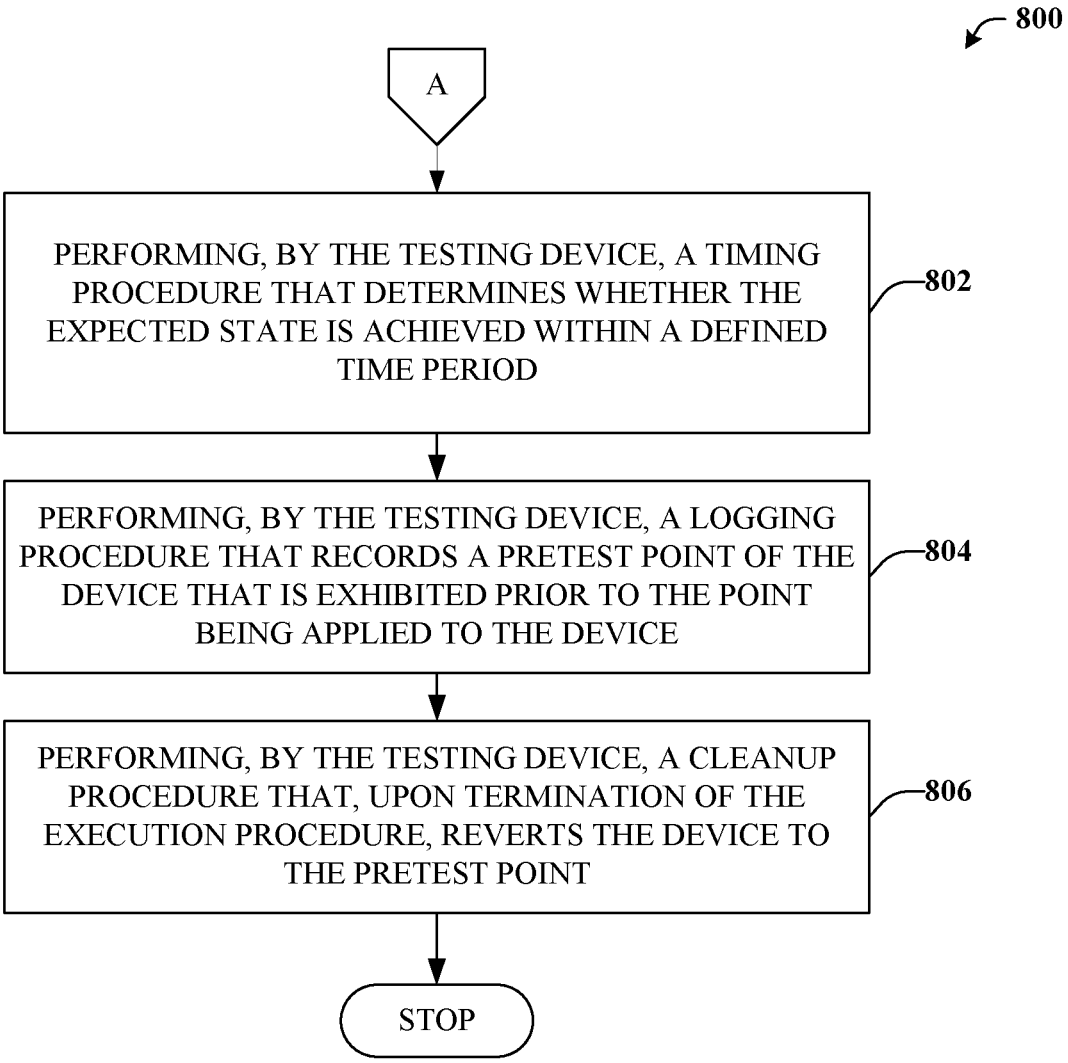
FIG. 8 illustrates a flow diagram of an example, non-limiting computer-implemented method that can provide additional aspects or elements in connection with automated function testing of an HVAC device or component in accordance with one or more embodiments of the disclosed subject matter.

FIGS. 7 and 8 illustrate various methodologies in accordance with the disclosed subject matter. While, for purposes of simplicity of explanation, the methodologies are shown and described as a series of acts, it is to be understood and appreciated that the disclosed subject matter is not limited by the order of acts, as some acts can occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

FIG. 7 illustrates a flow diagram 700 of an example, non-limiting computer-implemented method that can perform operations directed to automated function testing of an HVAC device or component in accordance with one or more embodiments of the disclosed subject matter. For example, at reference numeral 702, a device (e.g., testing device 102) comprising a processor can receive quiz data that defines a test of a device of a heating, ventilation, and air conditioning (HVAC) system, wherein the quiz data comprises a command that applies a point to the device and a predicate that is satisfied if the device exhibits an expected state in response to application of the point.

At reference numeral 704, the device can perform a verification procedure that is satisfied in response to determining that the device is capable of exhibiting the expected state. In other words, the verification procedure can verify certain elements prior to initiating the testing. As an example, the verification procedure can indicate a malformed test element and/or that the test cannot be passed (e.g., the expected outcome cannot occur).

At reference numeral 706, provided that the verification procedure is passed and/or satisfied, the device can perform an execution procedure. This execution procedure can comprise various elements including elements detailed at reference numerals 708 and 710 as well as other suitable elements as detailed herein, some of which are further discussed in connection with FIG. 8.

At reference numeral 708, the device can initiate execution of the quiz data with respect to the device. At reference numeral 710, the device can determine an exit condition that, when satisfied, will cause the execution of the quiz data to terminate prior to completion. Non-limiting examples of the exit condition can relate to determinations that executing the quiz data can cause an unsafe condition, unduly disrupt a service (e.g., heating, cooling, etc.) being provided by the HVAC system, and so forth. Method 700 can proceed to insert A, which is further detailed in connection with FIG. 8, or terminate.

Turning now to FIG. 8, illustrated is a flow diagram 800 of an example, non-limiting computer-implemented method that can provide additional aspects or elements in connection with automated function testing of an HVAC device or component in accordance with one or more embodiments of the disclosed subject matter.

At reference numeral 802, the device can perform a timing procedure that determines whether the expected state is achieved within a defined time period. In some embodiments, if the expected state is not achieved within the defined timer period, the associated command can be determined to fail. It is further appreciated that timing procedure can include the concepts of a centralized 'tick' introduced above, which can be used to synchronize certain network traffic or the like.

At reference numeral 804, the device can perform a logging procedure. The logging procedure can record a pretest point of the device that is exhibited prior to the point being applied to the device. In some embodiments, the logging procedure can further record resultant states exhibited by the device during the execution procedure. For example, states that are exhibited in response to application of the points of the quiz.

At reference numeral 806, the device can perform a cleanup procedure that, upon termination of the execution procedure, reverts the device to the pretest point.

Example Operating Environments

Figure 9:
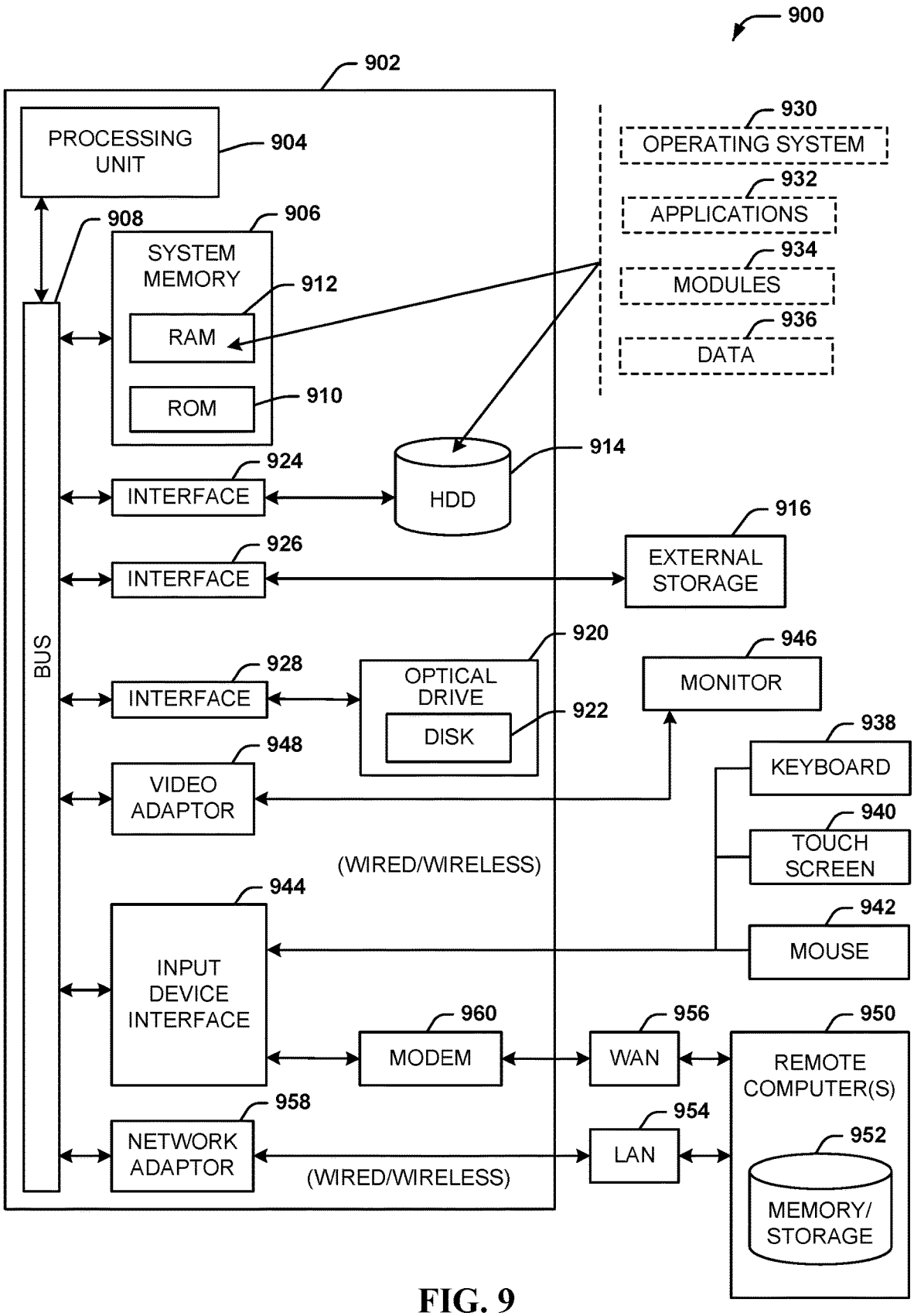
FIG. 9 illustrates a block diagram of an example, non-limiting operating environment in which one or more embodiments described herein can be facilitated.

In order to provide additional context for various embodiments described herein, FIG. 9 and the following discussion are intended to provide a brief, general description of a suitable computing environment 900 in which the various embodiments of the embodiment described herein can be implemented. While the embodiments have been described above in the general context of computer-executable instructions that can run on one or more computers, those skilled in the art will recognize that the embodiments can be also implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, Internet of Things (IoT) devices, distributed computing systems, as well as personal computers, hand-held computing devices, microprocessor-based or programmable consumer electronics, and the like, each of which can be operatively coupled to one or more associated devices.

The illustrated embodiments of the embodiments herein can be also practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media, machine-readable storage media, and/or communications media, which two terms are used herein differently from one another as follows. Computer-readable storage media or machine-readable storage media can be any available storage media that can be accessed by the computer and includes both volatile and nonvolatile media, removable and non-removable media. By way of example, and not limitation, computer-readable storage media or machine-readable storage media can be implemented in connection with any method or technology for storage of information such as computer-readable or machine-readable instructions, program modules, structured data or unstructured data.

Computer-readable storage media can include, but are not limited to, random access memory (RAM), read only memory (ROM), electrically erasable programmable read only memory (EEPROM), flash memory or other memory technology, compact disk read only memory (CD-ROM), digital versatile disk (DVD), Blu-ray disc (BD) or other optical disk storage, magnetic cassettes, magnetic tape, magnetic disk storage or other magnetic storage devices, solid state drives or other solid state storage devices, or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 9, the example environment 900 for implementing various embodiments of the aspects described herein includes a computer 902, the computer 902 including a processing unit 904, a system memory 906 and a system bus 908. The system bus 908 couples system components including, but not limited to, the system memory 906 to the processing unit 904. The processing unit 904 can be any of various commercially available processors. Dual microprocessors and other multi-processor architectures can also be employed as the processing unit 904.

The system bus 908 can be any of several types of bus structure that can further interconnect to a memory bus (with or without a memory controller), a peripheral bus, and a local bus using any of a variety of commercially available bus architectures. The system memory 906 includes ROM 910 and RAM 912. A basic input/output system (BIOS) can be stored in a non-volatile memory such as ROM, erasable programmable read only memory (EPROM), EEPROM, which BIOS contains the basic routines that help to transfer information between elements within the computer 902, such as during startup. The RAM 912 can also include a high-speed RAM such as static RAM for caching data.

The computer 902 further includes an internal hard disk drive (HDD) 914 (e.g., EIDE, SATA), one or more external storage devices 916 (e.g., a magnetic floppy disk drive (FDD) 916, a memory stick or flash drive reader, a memory card reader, etc.) and an optical disk drive 920 (e.g., which can read or write from a CD-ROM disc, a DVD, a BD, etc.). While the internal HDD 914 is illustrated as located within the computer 902, the internal HDD 914 can also be configured for external use in a suitable chassis (not shown). Additionally, while not shown in environment 900, a solid state drive (SSD) could be used in addition to, or in place of, an HDD 914. The HDD 914, external storage device(s) 916 and optical disk drive 920 can be connected to the system bus 908 by an HDD interface 924, an external storage interface 926 and an optical drive interface 928, respectively. The interface 924 for external drive implementations can include at least one or both of Universal Serial Bus (USB) and Institute of Electrical and Electronics Engineers (IEEE) 994 interface technologies. Other external drive connection technologies are within contemplation of the embodiments described herein.

The drives and their associated computer-readable storage media provide nonvolatile storage of data, data structures, computer-executable instructions, and so forth. For the computer 902, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 912, including an operating system 930, one or more application programs 932, other program modules 934 and program data 936. All or portions of the operating system, applications, modules, and/or data can also be cached in the RAM 912. The systems and methods described herein can be implemented utilizing various commercially available operating systems or combinations of operating systems.

Computer 902 can optionally comprise emulation technologies. For example, a hypervisor (not shown) or other intermediary can emulate a hardware environment for operating system 930, and the emulated hardware can optionally be different from the hardware illustrated in FIG. 9. In such an embodiment, operating system 930 can comprise one virtual machine (VM) of multiple VMs hosted at computer 902. Furthermore, operating system 930 can provide runtime environments, such as the Java runtime environment or the .NET framework, for applications 932. Runtime environments are consistent execution environments that allow applications 932 to run on any operating system that includes the runtime environment. Similarly, operating system 930 can support containers, and applications 932 can be in the form of containers, which are lightweight, standalone, executable packages of software that include, e.g., code, runtime, system tools, system libraries and settings for an application.

Further, computer 902 can be enable with a security module, such as a trusted processing module (TPM). For instance with a TPM, boot components hash next in time boot components, and wait for a match of results to secured values, before loading a next boot component. This process can take place at any layer in the code execution stack of computer 902, e.g., applied at the application execution level or at the operating system (OS) kernel level, thereby enabling security at any level of code execution.

A user can enter commands and information into the computer 902 through one or more wired/wireless input devices, e.g., a keyboard 938, a touch screen 940, and a pointing device, such as a mouse 942. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 904 through an input device interface 944 that can be coupled to the system bus 908, but can be connected by other interfaces, such as a parallel port, an IEEE 1394 serial port, a game port, a USB port, an IR interface, a BLUETOOTH® interface, etc.

A monitor 946 or other type of display device can be also connected to the system bus 908 via an interface, such as a video adapter 948. In addition to the monitor 946, a computer typically includes other peripheral output devices (not shown), such as speakers, printers, etc.

The computer 902 can operate in a networked environment using logical connections via wired and/or wireless communications to one or more remote computers, such as a remote computer(s) 950. The remote computer(s) 950 can be a workstation, a server computer, a router, a personal computer, portable computer, microprocessor-based entertainment appliance, a peer device or other common network node, and typically includes many or all of the elements described relative to the computer 902, although, for purposes of brevity, only a memory/storage device 952 is illustrated. The logical connections depicted include wired/wireless connectivity to a local area network (LAN) 954 and/or larger networks, e.g., a wide area network (WAN) 956. Such LAN and WAN networking environments are commonplace in offices and companies, and facilitate enterprise-wide computer networks, such as intranets, all of which can connect to a global communications network, e.g., the Internet.

When used in a LAN networking environment, the computer 902 can be connected to the local network 954 through a wired and/or wireless communication network interface or adapter 958. The adapter 958 can facilitate wired or wireless communication to the LAN 954, which can also include a wireless access point (AP) disposed thereon for communicating with the adapter 958 in a wireless mode.

When used in a WAN networking environment, the computer 902 can include a modem 960 or can be connected to a communications server on the WAN 956 via other means for establishing communications over the WAN 956, such as by way of the Internet. The modem 960, which can be internal or external and a wired or wireless device, can be connected to the system bus 908 via the input device interface 944. In a networked environment, program modules depicted relative to the computer 902 or portions thereof, can be stored in the remote memory/storage device 952. It will be appreciated that the network connections shown are example and other means of establishing a communications link between the computers can be used.

When used in either a LAN or WAN networking environment, the computer 902 can access cloud storage systems or other network-based storage systems in addition to, or in place of, external storage devices 916 as described above. Generally, a connection between the computer 902 and a cloud storage system can be established over a LAN 954 or WAN 956 e.g., by the adapter 958 or modem 960, respectively. Upon connecting the computer 902 to an associated cloud storage system, the external storage interface 926 can, with the aid of the adapter 958 and/or modem 960, manage storage provided by the cloud storage system as it would other types of external storage. For instance, the external storage interface 926 can be configured to provide access to cloud storage sources as if those sources were physically connected to the computer 902.

The computer 902 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, store shelf, etc.), and telephone. This can include Wireless Fidelity (Wi-Fi) and BLUETOOTH® wireless technologies. Thus, the communication can be a predefined structure as with a conventional network or simply an ad hoc communication between at least two devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration and are intended to be non-limiting. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random-access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A testing device, comprising:

a processor; and a memory that stores executable instructions that, when executed by the processor, facilitate performance of operations comprising:

receiving quiz data that defines a test of a device of a heating, ventilation, and air conditioning (HVAC) system, wherein the testing device is configured to communicate with the HVAC system, the testing device is interfaced to a network of the HVAC system according to a native protocol of the HVAC system, the quiz data comprises a command that applies a point to the device of the HVAC system and a predicate that is satisfied if the device of the HVAC system exhibits an expected state in response to application of the point;

performing a verification procedure to verify the quiz data prior to execution of the quiz data, the verification procedure being satisfied in response to determining that the device of the HVAC system is capable of exhibiting the expected state; and in response to the verification procedure being satisfied, performing an execution procedure, comprising:

recording a pretest point of the device of the HVAC system, wherein the pretest point is information regarding the device of the HVAC system prior to the point;

assigning the point that is to be applied to the device of the HVAC system a priority that is determined, based on the native protocol, to be higher than a pretest point priority and lower than a safety priority, initiating the execution of the quiz data with respect to the device of the HVAC system, wherein the execution of the quiz data comprises executing the command;

performing data collection; and determining whether an exit condition has been satisfied, wherein satisfaction of the exit condition causes the execution of the quiz data to terminate prior to completion;

in response to a determination that the exit condition has been satisfied, performing a cleanup procedure, wherein the cleanup procedure applies the pretest point to the device of the HVAC system; and upon completion of the execution procedure or termination of the execution procedure, analyzing a result of the data collection.

2. The testing device of claim 1, wherein the execution procedure further comprises:

a logging procedure that performs the recording of the pretest point of the device of the HVAC system, wherein the pretest point is exhibited prior to the point being applied to the device of the HVAC system.

3. The testing device of claim 2, wherein the cleanup procedure is performed in response to the termination of the execution procedure, if the exit condition is not satisfied.

4. The testing device of claim 3, wherein the cleanup procedure applies the pretest point to the device of the HVAC system in response to the exit condition being satisfied or the execution procedure completing.

5. The testing device of claim 2, wherein the logging procedure records points and states of the device of the HVAC system during the execution procedure and generates a report of the points or states of the device of the HVAC system during the execution procedure.

6. The testing device of claim 1, wherein the exit condition is determined to be satisfied in response to a determination that the execution procedure will violate a safety protocol.

7. The testing device of claim 1, wherein the exit condition is determined to be satisfied in response to a determination that a service provided by the HVAC system will be disrupted by the execution procedure.

8. The testing device of claim 1, wherein the execution procedure further comprises determining that the predicate is satisfied in response to determining, when the point is applied to the device of the HVAC system, that the device of the HVAC system exhibits the expected state within a defined time period or that the predicate is not satisfied if the expected state is not exhibited within the defined time period.

9. The testing device of claim 1, wherein the operations further comprise receiving exam data comprising the quiz data and second quiz data, wherein the second quiz data comprises a second command that applies a second point to a second device and a second predicate that is satisfied if the second device exhibits a second expected state in response to application of the second point.

10. The testing device of claim 1, wherein the testing device is network agnostic.

11. The testing device of claim 10, wherein the native protocol of the HVAC system is at least one of: a building automation control network (BACnet) protocol, a LonTalk protocol, a KNX protocol, a Modbus protocol, a ZibBee protocol, a Z-Wave protocol, an open source protocol for building automation, or a standardized protocol that is standardized by the American society of heating, refrigeration, and air conditioning engineers (ASHRAE).

12. The testing device of claim 10, wherein the operations further comprise generating a marriage certificate that translates the quiz data according to the native protocol.

13. A non-transitory computer-readable storage medium comprising instructions that, in response to execution, cause a testing device comprising a processor to perform operations, comprising:

receiving quiz data that defines a test of a device of a heating, ventilation, and air conditioning (HVAC) system, wherein the testing device is configured to communicate with the HVAC system, the testing device is interfaced to a network of the HVAC system according to a native protocol of the HVAC system, the quiz data comprises a command that applies a point to the device of the HVAC system and a predicate that is satisfied if the device of the HVAC system exhibits an expected state in response to application of the point;

performing a verification procedure to verify the quiz data prior to execution of the quiz data, the verification procedure being satisfied in response to determining that the device of the HVAC system is capable of exhibiting the expected state; and in response to the verification procedure being satisfied, performing an execution procedure, comprising:

recording a pretest point of the device of the HVAC system, wherein the pretest point is information regarding the device of the HVAC system prior to the point;

assigning the point that is to be applied to the device of the HVAC system a priority that is determined, based on the native protocol, to be higher than a pretest point priority and lower than a safety priority, initiating the execution of the quiz data with respect to the device of the HVAC system, wherein the execution of the quiz data comprises executing the command;

performing data collection; and determining whether an exit condition has been satisfied, wherein satisfaction of the exit condition causes the execution of the quiz data to terminate prior to completion;

in response to a determination that the exit condition has been satisfied, performing a cleanup procedure, wherein the cleanup procedure applies the pretest point to the device of the HVAC system; and upon completion of the execution procedure or termination of the execution procedure, analyzing a result of the data collection.

14. The non-transitory computer-readable storage medium of claim 13, wherein the testing device is network agnostic.

15. A method, comprising:

receiving, by a testing device comprising a processor, quiz data that defines a test of a device of a heating, ventilation, and air conditioning (HVAC) system, wherein the testing device is configured to communicate with the HVAC system, the testing device is interfaced to a network of the HVAC system according to a native protocol of the HVAC system, the quiz data comprises a command that applies a point to the device of the HVAC system and a predicate that is satisfied if the device of the HVAC system exhibits an expected state in response to application of the point;

performing, by the testing device, a verification procedure to verify the quiz data prior to execution of the quiz data, the verification procedure being satisfied in response to determining that the device of the HVAC system is capable of exhibiting the expected state; and in response to the verification procedure being satisfied, performing, by the testing device, an execution procedure, comprising:

recording a pretest point of the device of the HVAC system, wherein the pretest point is information regarding the device of the HVAC system prior to the point;

assigning the point that is to be applied to the device of the HVAC system a priority that is determined, based on the native protocol, to be higher than a pretest point priority and lower than a safety priority, initiating the execution of the quiz data with respect to the device of the HVAC system, wherein the execution of the quiz data comprises executing the command;

performing data collection; and determining whether an exit condition has been satisfied, wherein satisfaction of the exit condition causes the execution of the quiz data to terminate prior to completion;

in response to a determination that the exit condition has been satisfied, performing a cleanup procedure, wherein the cleanup procedure applies the pretest point to the device of the HVAC system; and upon completion of the execution procedure or termination of the execution procedure, analyzing a result of the execution procedure.

16. The method of claim 15, further comprising performing, by the testing device, a timing procedure that determines whether the expected state is achieved within a defined time period.

17. The method of claim 15, further comprising:

performing, by the testing device, a logging procedure that performs the recording of the pretest point of the device of the HVAC system, wherein the pretest point is exhibited prior to the point being applied to the device of the HVAC system.

18. The method of claim 17, further comprising:

performing, by the testing device, the cleanup procedure is performed in response to the termination of the execution procedure, reverts the device of the HVAC system to the pretest point if the exit condition is not satisfied.

19. The method of claim 15, wherein the testing device is network agnostic.

* * * * *